US005979549A

United States Patent [19]

Meeks

[11] Patent Number: 5,979,549

[45] Date of Patent: Nov. 9, 1999

[54] METHOD AND APPARATUS FOR VISCOSITY REDUCTION OF CLOGGING HYDROCARBONS IN OIL WELL

[76] Inventor: Thomas Meeks, 25590 Prospect Ave. 35B, Loma Linda, Calif. 92354

[21] Appl. No.: 08/959,777

[22] Filed: Oct. 29, 1997

[51] Int. Cl.[6] ..... F21B 36/00

[52] U.S. Cl. ..... 166/57; 122/1 R; 122/1 B; 122/1 C; 166/90.1; 166/303

[58] Field of Search ..... 166/57, 90.1, 91.1, 166/272.3, 272.6, 302, 303, 311, 312; 122/1 R, 1 B, 1 C; 431/202

[56] References Cited

U.S. PATENT DOCUMENTS

| | | | |
|---|---|---|---|
| 518,101 | 4/1894 | Gillet . | |
| 701,921 | 6/1902 | Musker et al. . | |
| 737,279 | 8/1903 | Ruby . | |
| 1,915,460 | 6/1933 | Wilson . | |
| 2,162,746 | 6/1939 | Randel . | |
| 2,937,624 | 5/1960 | Brogdon, Jr. . | |
| 2,947,689 | 8/1960 | Cain . | |
| 3,186,484 | 6/1965 | Waterman | 166/57 X |
| 3,288,214 | 11/1966 | Winkler . | |
| 3,357,407 | 12/1967 | Fanaritis . | |
| 3,563,210 | 2/1971 | Hoogendarn . | |
| 3,605,885 | 9/1971 | Leeper | 166/57 |
| 3,835,816 | 9/1974 | Ferrin . | |
| 4,007,786 | 2/1977 | Schlinger | 166/303 X |
| 4,244,684 | 1/1981 | Sperry et al. | 166/303 X |
| 4,299,278 | 11/1981 | Beehler | 166/57 X |
| 4,377,205 | 3/1983 | Retallick | 166/59 |
| 4,398,603 | 8/1983 | Rodwell | 166/267 |
| 4,398,604 | 8/1983 | Krajicek et al. | 166/303 |
| 4,403,575 | 9/1983 | Kral et al. . | |
| 4,474,011 | 10/1984 | Nelson et al. | 166/272.3 X |
| 4,498,542 | 2/1985 | Eisenhawer et al. | 166/303 |
| 4,730,673 | 3/1988 | Bradley | 166/272.3 |
| 5,472,341 | 12/1995 | Meeks | 431/243 |
| 5,517,822 | 5/1996 | Haws et al. | 122/1 R |
| 5,641,022 | 6/1997 | King | 166/303 |

*Primary Examiner*—George Suchfield
*Attorney, Agent, or Firm*—J. F. McLellan

[57] ABSTRACT

Method and apparatus for reducing the viscosity of clogging hydrocarbons in an oil well. The apparatus is preferably trailer mounted for portability. It includes a tube type heat exchanger enabling heated gases to pass within feed water coils to heat the water to a predetermined temperature and at a pressure which prevents any flashing or phase change of the feed water within the heat exchanger. From the heat exchanger the heated feed water passes through a conduit which empties into the oil well. The well is open to atmosphere so that the feed water undergoes a phase change or flashing when it is introduced into the oil well. The resulting combined steam and hot water reduce the viscosity of the hydrocarbons sufficiently to facilitate their flow out of the oil well. One embodiment of the heat exchanger includes special coil arrangements to promote heating efficiency.

2 Claims, 2 Drawing Sheets

METHOD AND APPARATUS FOR VISCOSITY REDUCTION OF CLOGGING HYDROCARBONS IN OIL WELL

BACKGROUND OF THE INVENTION

1. Field of the Invention

The present invention relates to a method and apparatus for reducing the viscosity of clogging hydrocarbons in an oil well. A heat exchanger controls the flashing of heated feed water into steam until after the feed water is injected into the oil well which is left open to atmospheric pressure.

2. Description of the Prior Art

Heated oil has been employed for years to increase the production of oil wells that are marginal producers because they are clogged at their upper or more shallow extremity by high viscosity organic solids or hydrocarbons such as paraffins and asphaltenes. These chokes off normal reservoir oil flow.

The heated oil process is a comparatively low cost method for rejuvenating such oil wells. Heated oil is trucked to the well and introduced into the well in sufficient quantity, and over a sufficient period of time, that the well strings and adjacent formation are heated enough to increase the viscosity of the clogging hydrocarbons to the point that they will flow out of the well with the reservoir oil.

The hot oil process is only practical for clearing the upper portion of a well because heated oil quickly loses its thermal energy as it sinks deeper into the well.

Steam injection is another expedient that has been used to treat hydrocarbon clogging by thermal reduction of its viscosity, particularly hydrocarbons that plug the perforations or slotted liner where the formation meets the wellbore.

The characteristics of steam make it more effective than hot oil for this kind of treatment, and also for treating moderately deeper portions of a well. Since steam does not drop in temperature until it is completely condensed, its thermal effect passes deeper into the well, as compared to a heated liquid like hot oil. Its heat content per pound is about three times that of water.

Further, saturated steam occupies approximately sixty times the volume of water at the same temperature and pressure, and the resultant pressure acts upon the surrounding formation to aid in driving the reduced viscosity oil out of the formation.

In one steam injection process of the prior art, described in U.S. Pat. No. 3,288,214 issued to A. K. Winkler, feed water was used that contained significant quantities of minerals and impurities. To avoid having these impurities pass into and possibly clog the formation when the steam was injected into the well, a packer was placed in the casing string to increase formation pressures and thereby increase the pressure at which the injected feed water would be flashed into steam.

This arrangement reduced the extent of flashing or vaporization of feed water to no more than about twenty percent by weight. This apparently had the effect of limiting the carry over of impurities into the steam, but the degree of vaporization also significantly reduced the available steam. Consequently, the injected water and steam behaved more like hot water or the hot oil of the prior art and the advantages of using steam were diminished accordingly.

Another problem with the bulk of the prior art hydrocarbon unclogging steam injection systems is that they were not portable, the boiler or steam generator typically being located at a central location, with field piping extending from the steam generator through distribution manifolds to the various wells in an oil field.

Thermal losses in such a system are high, the costs are high, and the flexibility of a portable arrangement is lost.

Prior art oil well steam generation equipment also was characterized by low efficiencies resulting from poor boiler design. This in turn caused high operating costs, such that the cost advantage of steaming a clogged well often exceeded the economic benefits of improved production. There is a continuing need, therefore, for a practical system for stimulating secondary oil production at reasonable costs.

SUMMARY OF THE INVENTION

According to the present invention, thermal energy delivery apparatus is provided which effectively reduces the viscosity of hydrocarbons clogging an oil well casing and the adjacent oil formation. In a preferred embodiment the apparatus has a capacity of approximately five million BTU, and can deliver steam at approximately 500 degrees Fahrenheit to sequentially treat or recondition about 100 wells per month. The apparatus includes a tube type heat exchanger having a horizontally oriented main portion adapted for coupling at one extremity to a combustor. A vertically oriented stack portion is connected to the main portion to carry off combustor gases.

The heat exchanger is a once-through system, which is highly efficient for various reasons, including the fact that it has no steam drum or mud drum and therefore no need for forced or natural circulation, or the blow down systems common in the prior art. Only a convention feed water pump is used to drive the feed water through the tubes of the heat exchanger.

According to the method of the invention, the feed water is initially treated by any suitable means, such as an ion exchange system, to reduce its mineral content and impurities. The treated feed water is then passed into an end coil of tubing located in the main portion extremity that is opposite the combustor extremity. This initially heats the feed water but, more importantly, cools the associated extremity so that it does not become overheated by the combustor gases coming through the interior of the main portion from the combustor.

A feed water conduit extends from the end coil upwardly from the main portion to the outside of the stack portion. It then extends downwardly from the top of the stack coil located within the stack portion to the bottom of the stack portion.

A feed water conduit from the bottom of the stack coil extends out of the stack coil and along the outside of the main portion, and then into the combustor end of a main coil located in the main portion. The main coil extends from the combustor extremity to a position just below the interior of the stack portion. At that point one end of a field conduit is connected to the main coil and extends into the open upper end of the well.

The temperature and pressure within the heat exchanger is controlled so that no feed water vaporization occurs upstream of the oil well. However, the temperature and pressure established are such that flashing of about forty percent by weight of the water occurs in the well at the atmospheric pressure present in the well.

The injection of heated feed water is continued at atmospheric pressure to flash it into steam to melt or decrease the viscosity of the clogging hydrocarbons. Normal pumping of the well can then be resumed.

The equipment used to carry out the foregoing operation is preferably mounted upon a trailer or the like so that it can be rolled up to an individual well for immediate operation. The combustor is preferably fueled from bottles or containers of fuel such as propane or natural gas carried on the trailer. Although other fuels such as diesel or lease crude could be used, this would require the use of expensive anti-pollution equipment such as scrubbers.

All power generation and control equipment is also mounted on the trailer for ready access. As a consequence of this arrangement, the expansion joints, steam headers, steam splitters, and long field laterals used in the prior art for treating a number of scattered wells at the same time from a central location are eliminated. Instead, as previously indicated, the present apparatus is simply rolled up to an individual well that is to be reconditioned, the well is treated, and the apparatus is then moved on to the next well. This greatly reduces the operating costs and the loss of thermal energy prior to discharge of the heated water into the well.

Other aspects and advantages of the present invention will become apparent from the following more detailed description taken in conjunction with the accompanying drawings.

DESCRIPTION OF A PREFERRED EMBODIMENT

Figure 1:
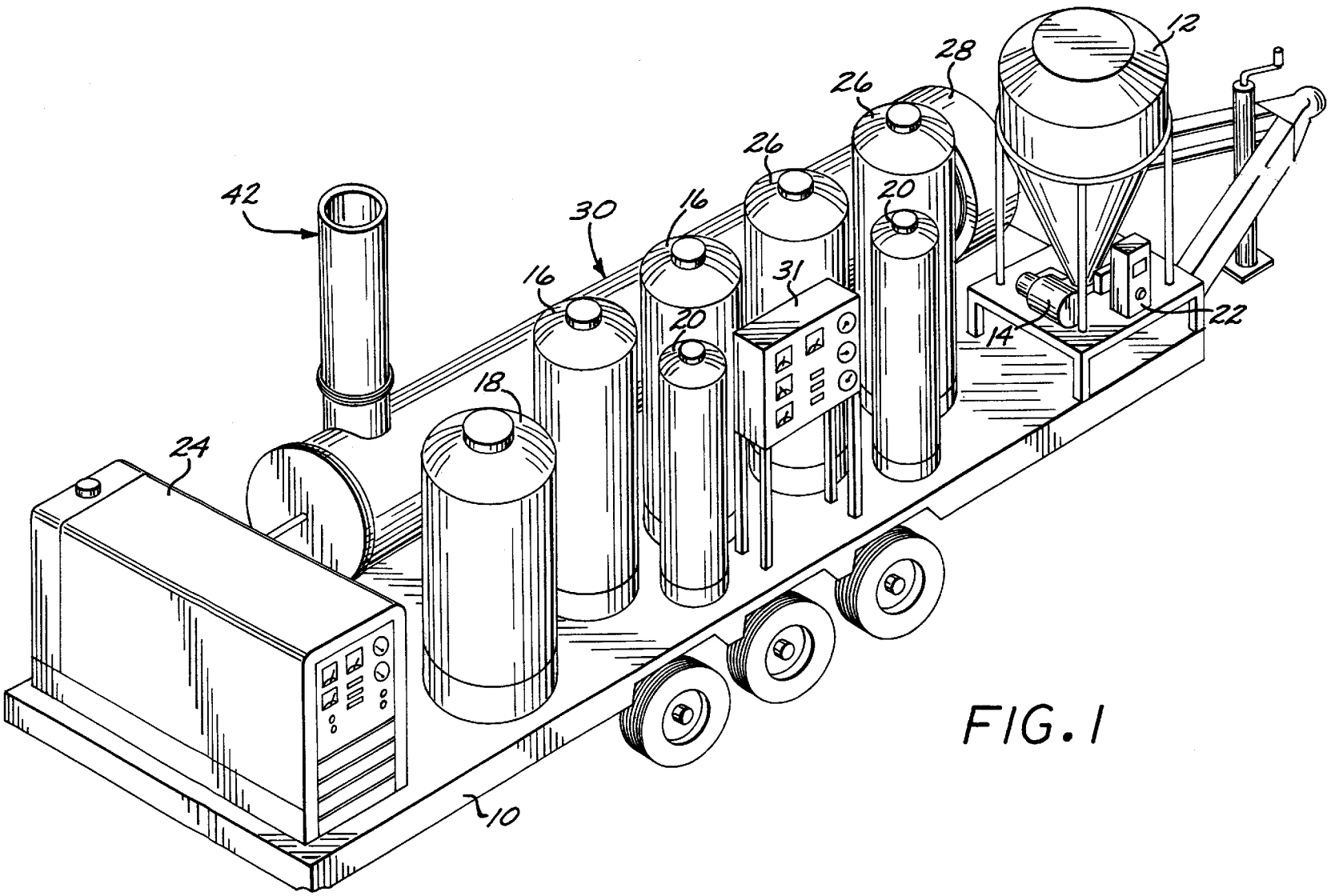
FIG. 1 is a perspective view of the apparatus of the present invention as it would appear mounted upon a trailer for transportation to and from a well site.

Referring now to the drawings, the present apparatus is illustrated in FIG. 1 is self contained, being mounted to a wheeled trailer 10 for easy portability to and from a well site. Mounted to the trailer, as schematically shown, is a water tank 12 from which feed water is drawn by a pump 14 for treatment in ion exchange tanks 16, a brine tank 18 and filters 20 of a conventional ion exchange system to reduce the level of any minerals and contaminants in the water.

A control system 22 automatically controls the upper level and lower level of the stored feed water, and feed water shutoff under predetermined conditions. A portable electrical generator 24 provides power for operating the pump 14 and other electrically energized components, and a pair of propane tanks 26 provide fuel to a burner or combustor 28 located at the combustor extremity of a boiler or heat exchanger 30. An associated control system 31 is also mounted on the trailer for conventional combustion management, and for operating suitable safety interlocks and shutdown mechanisms, including a relief valve, (not shown) to prevent over-pressurizing of the tubes in the heat exchanger. As will be apparent, the control systems can also be computerized if desired.

Suitable systems for accomplishing the foregoing are well known to those skilled in the art, and details of their construction and operation are therefore omitted for brevity.

As will be apparent, most combustible fuels will be satisfactory for combustion in the combustor 28, although fuels such as propane are preferred to reduce air pollution. Also, in those instances in which a source of relatively high quality or pure water is available, water purification or treatment equipment may be omitted.

Figure 2:
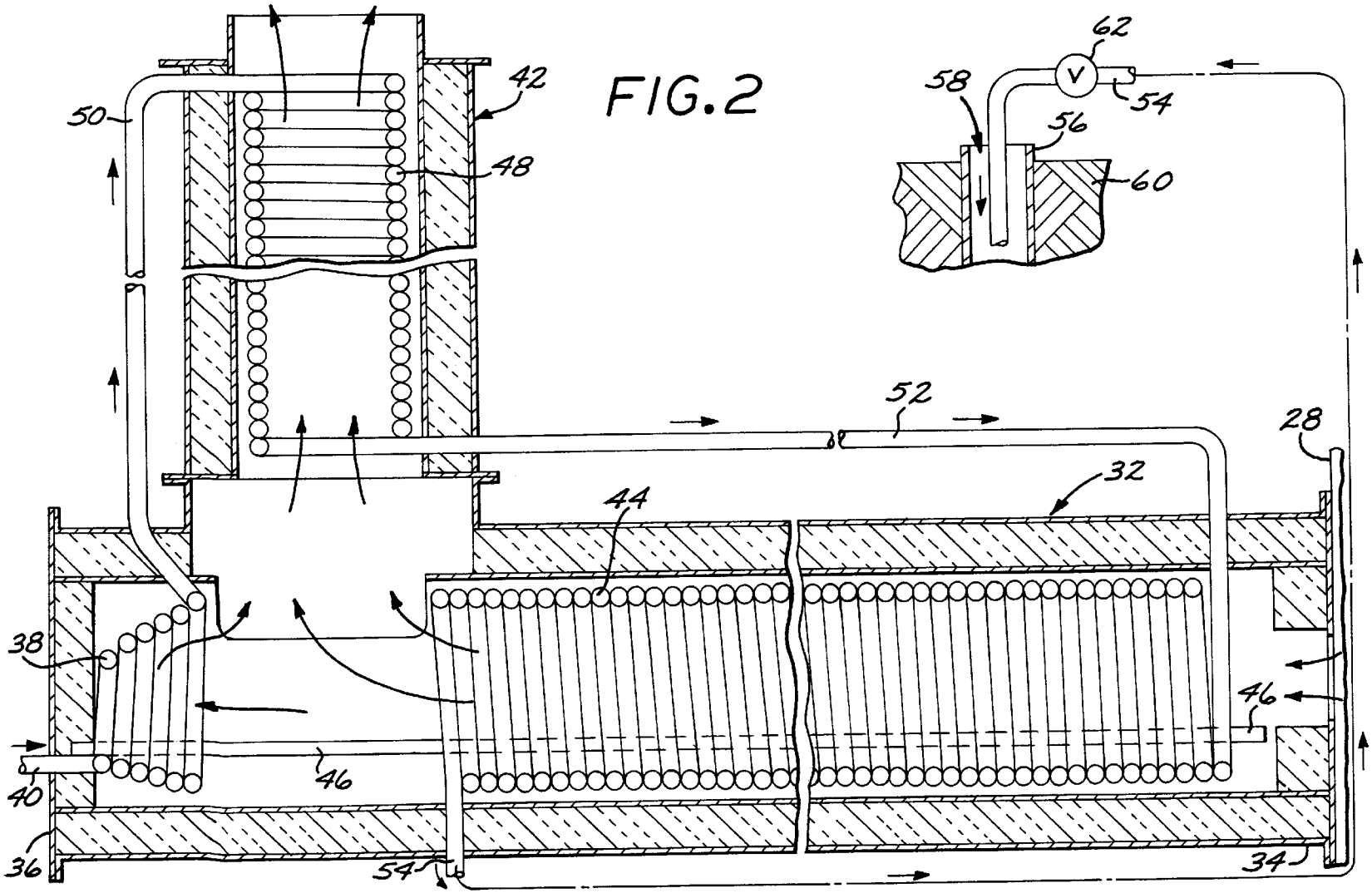
FIG. 2 is a simplified longitudinal cross-sectional view of the heat exchanger of the apparatus, and a schematic showing of the connection of the heat exchanger to the field conduit which carries the heated feed water to the well site for injection and vaporization in the upper end of a well which is open to atmospheric pressure.

As best seen in FIG. 2, the boiler or heat exchanger 30 includes a horizontally oriented main portion 32 having a combustor extremity 34 to which the combustor 28 is mounted, and a feed water extremity 36. A helical arrangement of tubing constituting an end coil 38 is suitably mounted within the interior of the end wall of the feed water extremity 36, and it is connected to the water treatment equipment on the trailer 10 by a feed water conduit 40.

There is an opening in the main portion 32 adjacent the end coil 38, and the lower end of a laterally directed, vertically oriented stack portion 42 is fixed to the main portion 32 in sealing relation so that the interior of the main portion 42 communicates with the interior of the stack portion 42. This routes hot combustion gases from the combustor 28 to the main portion 32, and then into the stack portion 42 for discharge to atmosphere from the upper end of the stack portion 42. These gases are at their hottest as they make their transition from the main portion 32 to the stack portion 42, and the presence of the end coil 38 serves both to preheat the feed water as it first enters the heat exchanger by way of the end coil 38, and also to prevent overheating and possible thermal damage to the end wall of the feed water extremity 36.

Although not shown, baffles are preferably disposed in the interiors of the main and stack portions 32 and 42 to slow the velocity of the heated gases passing through the interiors, thereby enhancing heat transfer from the gases to the feed water within the main and stack coils 44 and 48. In this regard, a goal of the invention is to adjust the parameters of operation such that the temperature of the gases passing out of the top of the stack portion 42 is as close as possible to the temperature of the heated feed water leaving the heat exchanger 30. Achievement of this condition is productive of maximum operating efficiencies, and it has been found that the particular components and component orientations used in the system described closely approach this condition.

The main and stack portions 32 and 42 each include outer and inner casings which are spaced apart to define an annular space. The annular spaces are filled with any suitable heat insulating material to minimize heat loss from the heat exchanger, as will be apparent.

A helically disposed tubing arrangement constituting a main coil 44 extends along the length of the main portion 32. It is suitably supported upon the interior wall by a plurality of circumferentially spaced standoffs 46 that are attached to the wall. A similarly supported tubing arrangement is located in the stack portion 42 and constitutes a stack coil 48.

A stack feed water conduit 50 is connected to the end coil 38 and extends vertically along the outside of the stack coil 48 to its upper end. From there the conduit is connected to the upper end of the stack coil 48 so that feed water passes downwardly through the stack coil 48.

The lower end of the stack coil 48 is connected to a main feed water conduit 52 which extends out of the stack portion 42 and along the outside of the main portion 32. This conduit 52 is connected to the combustor end of the main coil 44 so that feed water passes into the main coil and around the internal space through which the combustor gases pass.

The combustor end of the main coil 44 passes out of the main portion 32 and is connected to a discharge conduit 54 which extends into the open upper end of the casing string 56 of a producing well 58, forming a production string that extends through the upper portion of an oil formation 60.

The fact that the well 58 is open at the top places the interior of the well at atmospheric pressure.

A back pressure valve 62 or other suitable means is located in the discharge conduit 54 to maintain a predetermined back pressure in the heat exchanger 30. The valve 62 may be located anywhere in the conduit 54, preferably as close to the well 58 as possible, and if practicable at the base of the conduit 54 within the casing string 56.

The back pressure valve 62, the combustor 28 and the circulation of feed water through the system are controlled so that the feed water in the heat exchanger 30 is maintained at a temperature and pressure such that no vaporization of the feed water occurs in the exchanger. Consequently, there is no scale buildup on the coils or conduits by reason of any precipitation of minerals or other impurities in the feed water. All vaporization or flashing of the heated feed water to steam occurs within the well 58. In this regard, the temperature and pressure of the feed water when it reaches the well is preferably controlled so that approximately forty percent by weight of the water is vaporized. This percentage may vary somewhat under various operating conditions, but preferably the feed water temperature and pressure are closely monitored to achieve the desired minimum of forty percent vaporization. Maintaining the pressure in the well at atmospheric pressure is important in achieving this desirable result.

In the usual application, the vaporization of injected feed water is continued for between five and ten hours, depending upon the particular geological conditions of the oil formation. The clogging hydrocarbons are usually cleared out of the system by then, and normal pumping operations can be resumed. The treatment can be repeated as needed, depending upon the severity of the hydrocarbon clogging experienced at the well.

It is anticipated that heating the feed water to approximately 350 to 500 degrees Fahrenheit at a pressure of approximately 750 psia, and vaporizing the feed water at atmospheric pressure in the well for the indicated period of time, will produce the desired degree of vaporization necessary to adequately heat and melt paraffin and other hydrocarbon clogging agents in a zone about ten feet in diameter around the upper extremity of the casing string.

Various modifications and changes may be made with regard to the foregoing detailed description without departing from the spirit of the invention.

I claim:

1. Thermal energy delivery apparatus for reducing the viscosity of clogging hydrocarbons in an oil well in a secondary oil recovery operation, the apparatus comprising:

heat exchanger means including a main portion and a stack portion, the main portion having a combustor extremity adapted to receive hot combustion gases and further having a feed water extremity, the stack portion extending laterally of the main portion, the interiors of the main and stack portions being in communication whereby hot combustion gases introduced at the combustor extremity of the main portion pass through the main portion and laterally outwardly through the interior of the stack portion;

helical stack and main coils located in the main and stack portions, respectively;

a stack feed water conduit extending externally of the stack portion and connected to the upper extremity of the stack coil for directing feed water downwardly through the stack coil;

a main feed water conduit extending externally of the main portion and connecting the inner extremity of the stack coil with the main coil adjacent the combustor extremity for directing feed water through the main coil;

a discharge conduit connected to the main coil adjacent the feed water extremity, the discharge conduit extending laterally and externally of the main coil for discharge at atmospheric pressure into the open upper end of an oil well for flashing of the heated water into steam in the open upper end; and a back pressure valve located in the discharge conduit and operative to maintain the feed water at a pressure at which substantially no vaporization of the feed water occurs prior to the flashing of the feed water into steam in the upper end of the oil well.

2. Self-contained, portable thermal energy delivery apparatus for reducing the viscosity of clogging hydrocarbons in an oil well, and the apparatus comprising:

tube type heat exchanger means including a main portion and a stack portion, each of the portions having outer and inner cylindrical casings defining between them an annular space filled with heat insulating material, the main portion being horizontally oriented and having a combustor extremity adapted to receive hot combustion gases, and further having an oppositely located feed water extremity, the stack portion being located adjacent the feed water extremity and extending laterally and upwardly of the main portion, the interiors of the main and stack portions being in communication whereby hot combustion gases introduced at the combustor extremity of the main portion pass through the main portion and upwardly through the interior of the stack portion and out of the upper extremity of the stack portion;

a helical feed water receiving coil located in the main portion adjacent the feed water extremity;

helical stack and main coils located in the main and stack portions, respectively;

a stack feed water conduit extending externally of the stack portion and connecting the feed water receiving coil with the upper extremity of the stack coil for directing feed water through the stack coil;

a main feed water conduit extending externally of the main portion and connecting the lower extremity of the stack coil with the main coil at a point adjacent the combustor extremity for directing feed water through the main coil;

a discharge conduit connected to the main coil adjacent the feed water extremity, the discharge conduit extending laterally and externally of the main coil for discharge at atmospheric pressure into the open upper end of an oil well for flashing of the heated water into steam in the well; and a back pressure valve located in the discharge conduit and operative to maintain the feed water at a pressure at which substantially no vaporization of the feed water occurs prior to the flashing of the feed water into steam in the oil well.

* * * * *